US009488147B2

(12) United States Patent
Quack et al.

(10) Patent No.: US 9,488,147 B2
(45) Date of Patent: Nov. 8, 2016

(54) STARTER FOR AN INTERNAL COMBUSTION ENGINE

(71) Applicant: Robert Bosch GmbH, Stuttgart (DE)

(72) Inventors: Tobias Quack, Bergisch Gladbach (DE); Gerd-Peter Schmieder, Ludwigsburg (DE); Bernhard Mader, Kernen (DE); Andreas Jesse, Freudental (DE)

(73) Assignee: Robert Bosch GmbH, Stuttgart (DE)

( * ) Notice: Subject to any disclaimer, the term of this patent is extended or adjusted under 35 U.S.C. 154(b) by 164 days.

(21) Appl. No.: 14/206,851

(22) Filed: Mar. 12, 2014

(65) Prior Publication Data

US 2014/0260796 A1 Sep. 18, 2014

(30) Foreign Application Priority Data

Mar. 13, 2013 (DE) ..... 10 2013 204 393

(51) Int. Cl.
*F02N 11/00* (2006.01)
*F02N 15/04* (2006.01)

(52) U.S. Cl.
CPC ..... *F02N 11/00* (2013.01); *F02N 15/04* (2013.01); *F02N 15/046* (2013.01); *Y10T 74/137* (2015.01)

(58) Field of Classification Search
CPC ..... F02N 5/00; F02N 5/02; F02N 11/00; F02N 11/08; F02N 11/0851; F02N 11/0855; F02N 15/02; F02N 15/022; F02N 15/025; F02N 15/04; F02N 15/043; F02N 15/046; Y10T 74/13; Y10T 74/131; Y10T 74/137
USPC ..... 74/7 A, 7 E, 8; 185/41 A
See application file for complete search history.

(56) References Cited

U.S. PATENT DOCUMENTS 1,472,872 A * 11/1923 Kindl ..... F02N 15/04 123/179.22
1,589,459 A * 6/1926 Brockway ..... F02N 19/001 123/185.9
1,622,377 A * 3/1927 Gilchrist ..... F02N 15/04 123/179.25
1,642,109 A * 9/1927 Hodges ..... F02N 15/04 74/8
1,795,078 A * 3/1931 Davies ..... F02N 15/04 123/185.9
1,960,967 A * 5/1934 Chandler ..... F02N 15/08 191/85
1,997,571 A * 4/1935 Billon ..... F02N 15/04 185/41 R
2,755,670 A * 7/1956 Meyer ..... F02N 15/00 74/8
5,823,048 A * 10/1998 Saupe ..... F02N 15/006 192/42
7,194,925 B2 * 3/2007 Kajino ..... F02N 15/063 475/290
7,237,447 B2 * 7/2007 Cilibraise ..... F02N 15/046 474/134
7,451,668 B2 * 11/2008 Hasegawa ..... F02N 15/023 464/46

FOREIGN PATENT DOCUMENTS

| | | |
|---|---|---|
| CH | 97941 | 2/1923 |
| DE | 358082 | 9/1922 |
| DE | 102011088219 | 6/2013 |
| DE | 102012210687 | 1/2014 |
| FR | 2545543 | 11/1984 |

* cited by examiner

*Primary Examiner* — David M Fenstermacher
*Assistant Examiner* — Leonard J Archuleta
(74) *Attorney, Agent, or Firm* — Michael Best & Friedrich LLP

(57) ABSTRACT

A starter for an internal combustion engine comprises a starter motor and a starter pinion which can be displaced transversely to the longitudinal axis of the motor. The starter pinion is rotatably mounted in an eccentric component which is connected in a rotationally fixed manner to a rotatable transmission component of a transmission that is disposed between the starter motor and the starter pinion.

15 Claims, 3 Drawing Sheets

STARTER FOR AN INTERNAL COMBUSTION ENGINE

BACKGROUND OF THE INVENTION

The invention relates to a starter for an internal combustion engine.

The German patent specification DE 358 082 A describes a starter for an internal combustion engine which has an electric starter motor the rotational movement of which is transmitted via gears to a starter pinion. The starter pinion can be adjusted in a radial direction between an inoperative position and an engaged position with a crown gear of the internal combustion engine. The starter motor actuates a drive pinion which meshes with a slew pinion that is jointly disposed with the starter pinion on a shaft running parallel to the drive shaft. The slew pinion meshes with the internal teeth of a ring gear which is disposed coaxially to the drive shaft and can revolve about the same.

After the start-up of the electric starter motor, the ring gear still initially remains in the initial rotational position thereof due to the relatively high inertia thereof, wherein the slew pinion runs jointly with the starter pinion along the internal teeth of the ring gear until achieving the engaged position between starter pinion and ring gear. In the further course of action, the ring gear begins to rotate. The drive movement of the starter motor is then transmitted into a rotation of the starter pinion which actuates the ring gear of the internal combustion engine.

The Swiss patent application CH 97 941 discloses a starter for an internal combustion engine comprising a starter pinion that is radially pivotally mounted. The starter pinion is accommodated in a tiltable sleeve which can be pivoted concentrically with respect to the longitudinal axis of the motor, wherein the starter pinion executes the desired radial movement in the direction of the crown gear by means of the pivoting movement of the tiltable sleeve due to the eccentric mounting thereof.

SUMMARY OF THE INVENTION

The aim underlying the invention is to design a starter for an internal combustion engine using simple measures in a compact and operationally reliable manner, the starter pinion of which can be deflected transversely or radially with respect to the longitudinal axis of the motor.

The inventive starter is used with internal combustion engines and comprises an electric starter motor as well as a starter pinion that is actuated by the starter motor. The starter pinion can be adjusted transversely or radially to the longitudinal axis of the starter motor between an inoperative position and an engaged position with the crown gear of the internal combustion engine. In relation to the longitudinal axis of the motor, the actuation of the starter pinion can relate to a radial movement, a translatory tangential movement or to a movement along a curved path, for example, along a circular path which lies in a plane vertical to the longitudinal axis of the motor.

The starter pinion is rotatably mounted in an adjustable eccentric component which in turn is rotatably accommodated in a housing of the starter. The starter pinion is arranged eccentrically to the rotational axis of the eccentric component; thus enabling the starter pinion to carry out the desired transverse or radial movement during a rotational movement of the eccentric component.

In the case of the inventive starter, the eccentric component is designed in a rotatably fixed manner with a transmission component that is a constituent part of a transmission disposed between starter motor and starter pinion. By means of the transmission, the rotational speed of the motor is reduced to a lower starter pinion rotational speed. The one-piece embodiment results in the eccentric component and the transmission component having the same longitudinal or rotational axis and being jointly rotatably mounted in the accommodating housing. A one-piece embodiment is also worth considering in which the eccentric component and the transmission component are designed as a common component as well as an embodiment as two or several separate components that are however connected to one another in a rotatably fixed manner.

The transmission component can be rotated between an initial position in which the starter pinion is disengaged from the crown gear and a start position in which the starter pinion is engaged with the crown gear of the internal combustion engine. The transmission component therefore serves to impress the meshing movement onto the starter pinion.

This embodiment has the advantage that the transmission, which is connected downstream of the starter motor, can be used for the meshing movement of the starter pinion. As a result of the one-piece embodiment of eccentric component and transmission component, a compact embodiment is achieved in which the adjusting movement of the starter pinion can be carried out with low friction due to a reduced number of components.

The transmission component, which is designed to be rotationally fixed to the eccentric component, also serves, in particular in the start position in which the starter pinion is engaged with the crown gear, to transmit movement in the transmission path between starter motor and starter pinion. Said transmission component thus serves a dual function: firstly the adjusting movement of the starter pinion is carried out with the aid of the transmission component and secondly, in the meshed state, the drive movement of the starter motor is transmitted via the transmission component to the starter pinion.

According to a preferred embodiment, the adjusting movement of the transmission component takes place by means of the starter motor between the initial position thereof and the start position; and thus no additional actuator, such as, e.g., a starter relay is required. Upon switching on the starter motor and the rotational movement of the motor shaft beginning, the transmission component, which is rotatably mounted in the housing of the starter, is rotated in a first movement phase from the initial position into the start position. The transmission component thereby executes a rotary movement about the longitudinal axis thereof. The rotary movement is accompanied by the meshing movement of the of the starter pinion.

After the transmission component has achieved the start position thereof, the next movement phase follows the first movement phase. In said next movement phase, a further rotation of the transmission component is prevented in the accommodating housing and instead the transmission component serves to support further components of the transmission and to transmit movement; thus enabling the rotational movement of the motor shaft of the starter motor to be converted into a rotational movement of the starter pinion.

According to a preferred embodiment, the transmission is designed as a planetary gear set and the transmission component as a ring gear of the planetary gear set. Planet gears which are rotatably mounted on a planet carrier mesh in the ring gear, wherein the planet gears are driven by a sun gear which is mounted to the motor shaft of the starter motor in a rotatably fixed manner. The ring gear is to be rotated about the longitudinal axis thereof about a defined angular amount between the initial position and the start position. The rotary movement of the ring gear is achieved via the starter motor and the upstream gears, i.e. the sun gear and the planet gears. When the start position has been achieved, the ring gear is fixed relative to the housing; thus enabling the planet gears to roll on the inside of the ring gear and the planet carrier to execute a rotational movement which can be transmitted to the starter pinion.

The rotational movement of the ring gear in the housing is advantageously delimited by a stop on the housing side. Upon reaching the stop, the ring gear is located in the start position When the starter motor is switched on, the planet carrier is situated advantageously during the first movement phase in a blocked position in the housing so that the planet carrier can not revolve. The drive movement of the motor shaft is transmitted via the sun gear and the planet gears on the stationary planet carrier to the ring gear which is transferred from the initial position to the start position.

According to a further advantageous embodiment, a coupling device designed expediently in a force-closed or form-fit manner is assigned to the planet carrier, said gear displacing the planet carrier between a blocking position and a release position. In the blocking position, which the planet carrier assumes in the first movement phase, the planet carrier is blocked or locked so as to be fixed to the housing. In the release position, which the planet carrier assumes in the subsequent second movement phase, the planet carrier can in contrast rotate in the housing.

The coupling device can, for example, be embodied as a cone clutch or comprise wrap springs, friction linings in strip form, centrifugal clutches, etc.

According to a further advantageous embodiment, the coupling state can be adjusted with the aid of an actuator, the adjusting movement of which is tapped from the rotational movement of the ring gear. This embodiment has the advantage that an active adjusting device is not required to change the coupling state. In fact, it is sufficient to kinematically couple the actuator of the coupling device to the ring gear; thus enabling the rotatory ring gear movement to set the coupling state of the coupling device.

The actuator of the coupling device is, for example, embodied as a push nut which is mounted on the external thread of the ring gear and is axially guided in a guide groove on the housing side. The external thread is particularly embodied as a helix thread, wherein, due to the axial guidance of the push nut in the guide groove on the housing side, the push nut executes an axial adjusting movement during a rotational movement of the ring gear. Said axial adjusting movement of the push nut is used for setting the coupling state.

The coupling device comprises, for example, a plurality of clutch plates which are partially disposed on the housing side and partially on the planet carrier in a rotatably fixed manner; however, being able to be axially adjusted. The actuator acts on the clutch plates and presses the same together to achieve the blocking position; whereas, in the release position, the actuator reduces the pressure on the clutch plates or relieves the clutch plates of the pressure. In the embodiment as a push nut, said nut presses axially against the plates in the blocking position or detaches from the plates in order to achieve the release position.

The rotational movement of the transmission component coupled to the eccentric component advantageously extends across an angular region of maximally 180°, for example across an angle of 45°. The actuation of the starter pinion can already take place prior to achieving the start position of the transmission component; thus enabling the actuation of the starter pinion to already begin in the first movement phase, which has the advantage that the starter pinion meshes into the crown gear when said pinion is rotating. The risk of a jamming tooth to tooth position is thereby reduced.

According to a further expedient embodiment and particularly in addition to the planetary gear set, the transmission can comprise a double ring gear stage having two gears which both revolve in a further ring gear of the transmission, wherein the ring gear is rotatably mounted in the eccentric component. The eccentric offset with a 1:1 gear ratio can be bridged via the double ring gear stage. The gear of the double ring gear stage on the input side is advantageously fixedly connected to the planet carrier and is therefore driven by the planet carrier. The rotation of the first gear is transmitted to the ring gear which drives the second gear that is fixedly coupled to the starter pinion. The axes of the two gears of the double ring gear stage are offset to one another by the same eccentric distance with which the longitudinal axis of the starter pinion is also offset with respect to the longitudinal axis of the motor shaft. The ring gear of the double ring gear stage is advantageously located within the eccentric component and is rotatably mounted in the same.

BRIEF DESCRIPTION OF THE DRAWINGS

Further advantages and expedient embodiments of the invention are to be extracted from the additional claims, the description of the figures and the drawings. In the drawings:

DETAILED DESCRIPTION

Figure 1:
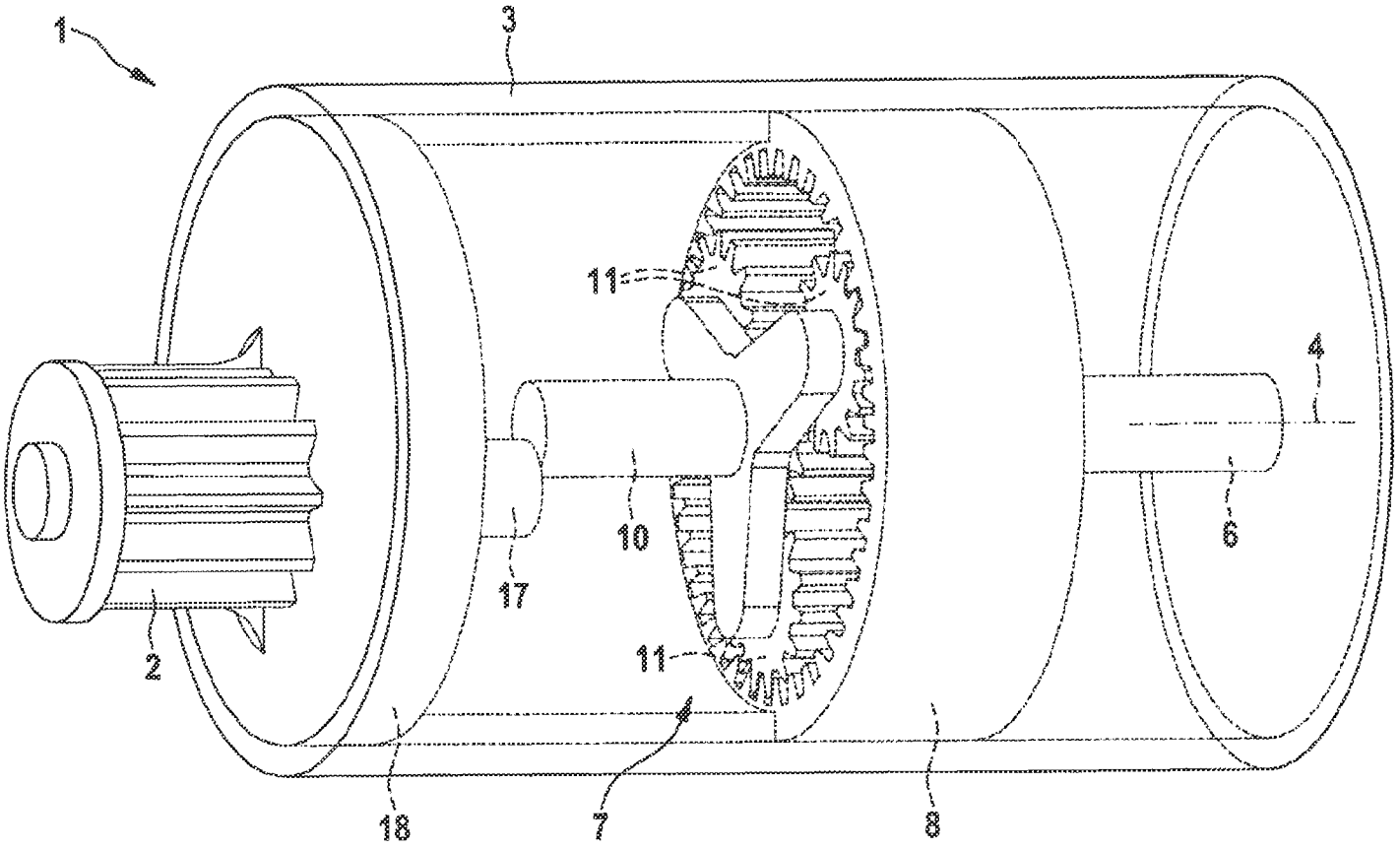
FIG. 1 shows a starter for an internal combustion engine comprising a starter pinion that is adjusted transversely to the longitudinal axis into the engaged position with the crown gear of an internal combustion engine, in perspective view.

Identical components are provided with the same reference numerals in the figures.

Figure 2:
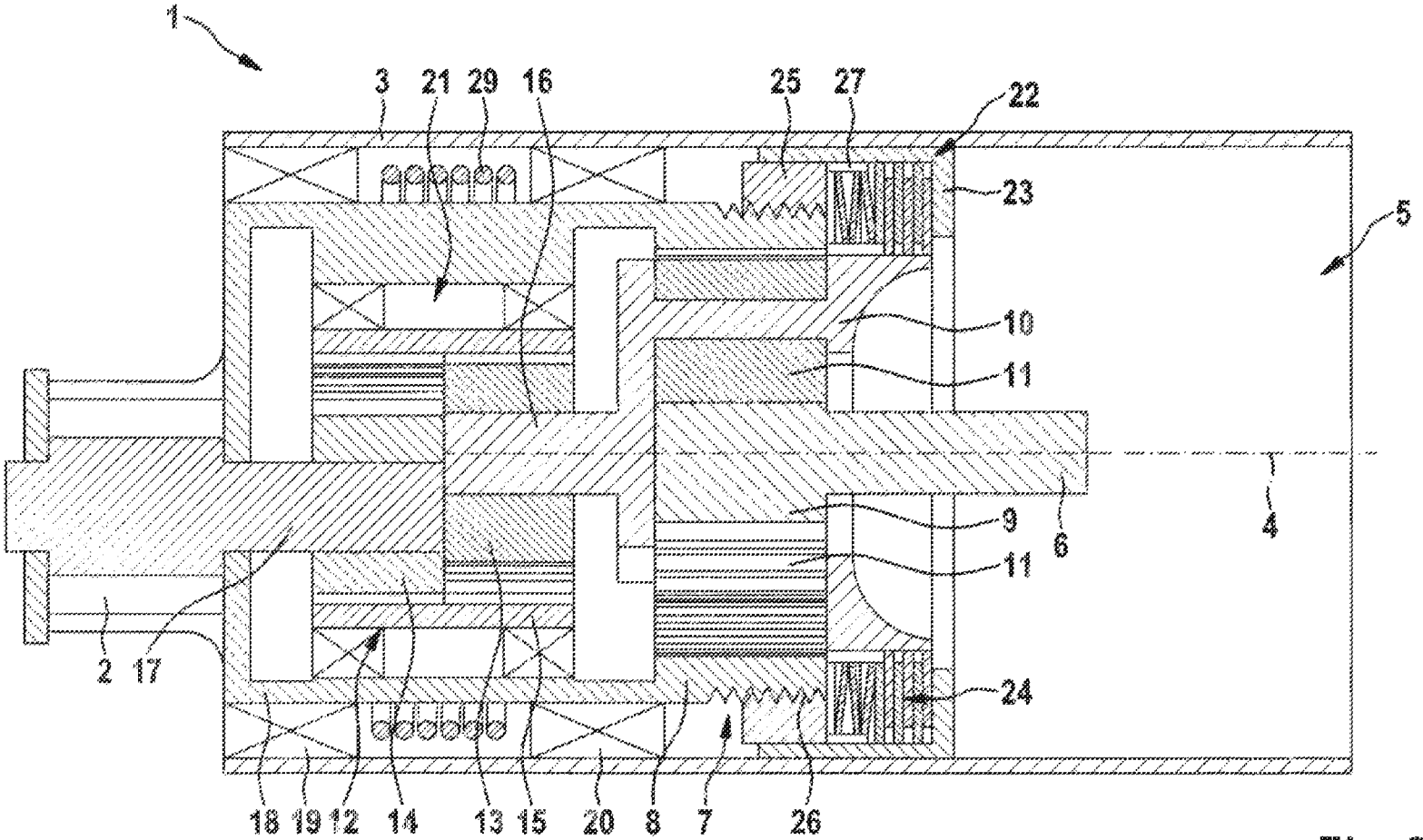
FIG. 2 shows the starter in a longitudinal section view.

FIGS. 1 and 2 show a starter 1 for an internal combustion engine comprising a starter pinion 2 which, in order to mesh with a crown gear of an internal combustion engine, executes an adjusting movement in a housing 3 between an outer engagement position and an engagement position which is transversely or radially aligned to the longitudinal motor axis 4 of an electric starter motor 5. The motor shaft 6 of the starter motor 5 is coupled by means of a planetary gear set 7 to the starter pinion 2 and drives the same. The rotational movement of the motor shaft 6 of the starter motor is furthermore used to carry out the adjusting movement of the starter pinion 2 transversely to the longitudinal axis 4 of the motor in order to mesh the starter pinion.

Figure 3:
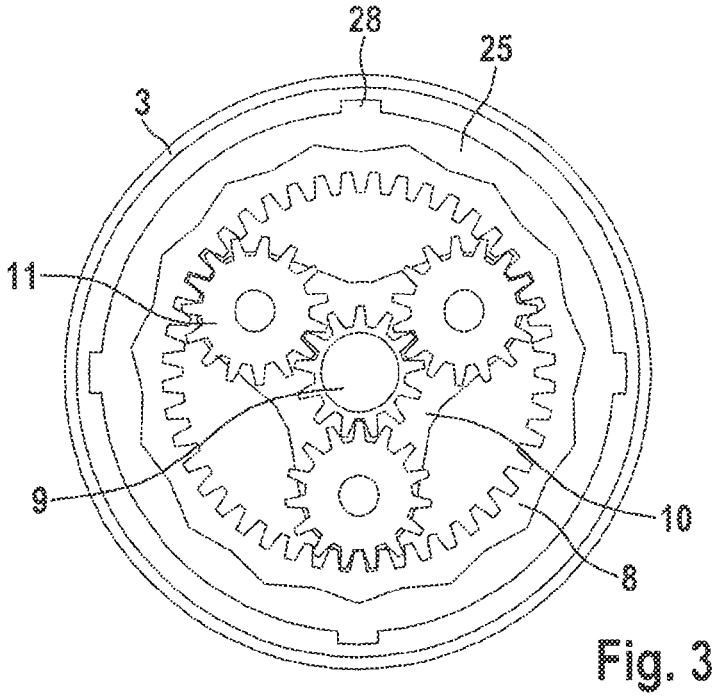
FIG. 3 shows an end face view of a planetary gear set in the starter.
Figure 4:
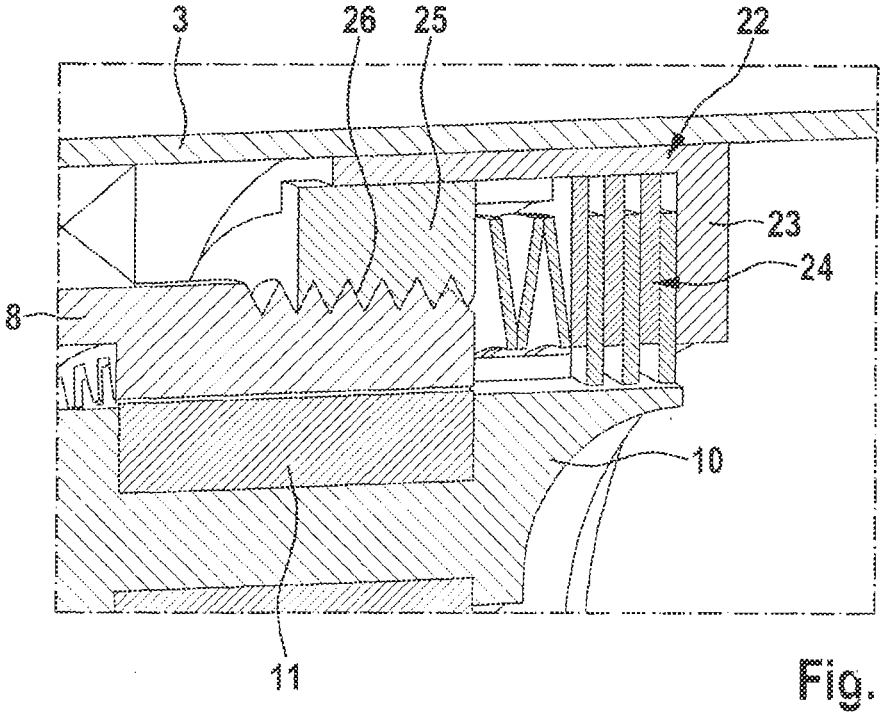
FIG. 4 shows an enlarged depiction of a section of the starter in the region of a coupling device, by means of which a planet carrier of the transmission can be blocked so as to be fixed to the housing.

As can be extracted from FIGS. 1 and 2 in combination with the further FIGS. 3 and 4, the planetary gear set 7 comprises a ring gear 8 which is rotatably mounted in the housing 3 of the starter. The planetary gear set 7 furthermore comprises a sun gear 9, which is disposed in a rotationally fixed manner on the motor shaft of the starter motor and a planet carrier 10 which includes three planet gears 11 that are rotatably mounted on the planet carrier. The planet gears 11 on the planet carrier 10 mesh with the internal teeth of the ring gear 8.

A double ring gear stage 12 (FIG. 2) is disposed downstream of the planetary gear set 7. The double ring gear stage 12 comprises a first and second gear 13, 14 as well as a further, second ring gear 15, wherein the first gear 13 is accommodated in a rotationally fixed manner on a central axle pin 16 and the second gear 14 is mounted in a rotationally fixed manner on a shaft 17 to which the starter pinion 2 is also connected. The axle pin 16 of the planet carrier 10 lies coaxially with respect to the motor shaft 6, whereas the shaft 17 is disposed parallel to the motor shaft offset by an eccentric distance.

The shaft 17 is rotatably mounted in an eccentric component 18 which is configured in one or multiple parts with the ring gear 8 of the planetary gear set. Ring gear 8 and eccentric component 18 form a contiguous, common component which is mounted so as to pivot about the longitudinal motor axis 4 in the housing 3, which can relate to a pole housing of the starter motor. The mounting takes place via the mounting points 19 and 20.

A further mounting point 21 is located within the eccentric component 18 in order to mount the second ring gear 15 which is a constituent part of the double ring gear stage 12. The double ring gear stage 12 facilitates a bridging of the eccentric offset between the longitudinal motor axis 4 and the longitudinal or rotational axis of the starter pinion 2 at a gear transmission ratio of 1:1.

A coupling device 22 is assigned to the planet carrier 10 of the planetary gear set 7, via which device the planet carrier 10 can be adjusted between a release position and a blocking position, wherein the planet carrier 10 can rotate in the release position and is locked in the blocking position so as to be fixed to the housing. The coupling device 22 comprises a clutch basket 23 which is disposed so as to be fixed to the housing and which includes a plurality of clutch plates 24 which are connected in part to the planet carrier 10 so as to be fixed to the housing and in part to said carrier in a rotationally fixed manner; however, being displaceably disposed in the axial direction. The clutch plates 24 are subjected to an axial force via an actuator of the coupling device that is embodied as a push nut 25; thus enabling the blocking position to be achieved as a result of friction between the clutch plates. Conversely the coupling device moves into the release position if the push nut 25 axially detaches from the clutch plates 24.

The push nut 25 is mounted to the outer lateral surface of the ring gear 8 and is coupled to the ring gear 8 via a helix thread 26. The push nut 25 has a guide lug 28 on the radially outer side thereof (FIG. 3) which protrudes into a guide groove 27 on the inner side of the housing 3. The push nut 25 is of annular configuration and has a plurality of guide lugs distributed over the circumference thereof which protrude into associated guide grooves on the housing side.

During a rotational movement of the ring gear 8, the push nut 25 executes an axial sliding movement parallel to the longitudinal axis 4 of the motor. Depending on the rotational direction of the ring gear 8, the push nut 25 is either displaced in the direction of the clutch plates 24 or in the opposite direction.

The starting sequence proceeds as follows: Upon starting the electric starter motor 5, the motor shaft 6 is set in rotation. This rotational movement is transmitted via the sun gear 9 to the planet gears 11. In this first phase of the starting sequence, the planet carrier 10 is situated in the blocking position and can therefore not revolve in the housing. In the blocking position, the coupling device 22 is blocked by the push nut 25.

The rotational movement of the planet gears 11 is transmitted via the internal teeth to the ring gear 8 which then executes a rotational movement about the longitudinal motor axis 4 in the housing 3. Said rotational movement is limited to an angular amount that is preferably less or equal to 180°, for example to 45°. Due to the one-piece design with the ring gear 8, the eccentric component 18 also executes a corresponding rotational movement about the longitudinal axis 4 of the motor shaft. Because the shaft 17, on which the starter pinion 2 is mounted, is eccentrically offset with respect to the longitudinal motor axis 4, a radial engagement movement of the starter pinion 2 is produced as a result of the rotational movement of ring gear 8 and eccentric component 18.

The rotational movement of the ring gear 8 in the housing 3 is delimited by stops. It is thereby ensured that the ring gear 8 can only be rotated between the initial position thereof, which the ring gear assumes prior to start-up of the starter motor, and the start position in which the starter pinion is in engagement with the crown gear of the internal combustion engine.

The rotational movement of the ring gear 8 is kinematically transmitted via the helix thread 26 into an axial adjusting movement of the push nut 25 which is then displaced out of the blocking position into the releasing position, so that the coupling device 22 is no longer blocked and the planet carrier 10 is released and can rotate in the housing 3 about the longitudinal motor axis 4. Because a further adjusting movement of the ring gear 8 is prevented at the same time by the stop on the housing side, the driving movement of the motor shaft 6 is transmitted via the sun gear 9, the planetary gear set 11, the ring gear 8, planet carrier 10 and the components of the double ring gear stage 12 into a driving movement of the starter pinion 2.

The actuation of the starter pinion 2 already takes place during the transfer movement of the ring gear 8 from the initial position into the start position. Thus, the actuation of the starter pinion does not occur abruptly upon the ring gear achieving the start position but already begins bit by bit in an intermediate position of the ring gear.

After the successful start-up of the internal combustion engine, the starter pinion has to then be disengaged. To this end, the electric starter motor is switched off. The ring gear 8 is rotated via a spring element 29 out of the start position back into the initial position, wherein this rotational movement is also transmitted via the kinematic coupling onto the push nut 25 of the coupling device and the coupling device therefore moves again into the blocking position in which the planet carrier is prevented from revolving in the housing. The spring element 29 is located on the outside of the eccentric component 18 or ring gear 8 and supports said eccentric component 18 or said ring gear 8 in the circumferential direction on the housing 3. During the first phase of the starting movement, the ring gear 8 is rotated against the force of the spring element 29. Upon completing the starting process, the energy stored in the spring element 29 is used to reset the ring gear 8 or, respectively, the eccentric component 18.

A freewheel device is advantageously integrated into the starter in order to ensure that, after the start-up of the internal combustion engine, the higher rotational speeds are not transmitted to the starter motor. The freewheel device is preferably located between the planetary gear set and the starter pinion.

What is claimed is:

1. A starter for an internal combustion engine, comprising a starter motor (5) and a drivable starter pinion (2) which is displaceable transversely to a longitudinal motor axis (4) between a disengaged position and an engaged position with a crown gear of an internal combustion engine, wherein the starter pinion (2) is rotatably mounted in an adjustable eccentric component (18), characterized in that the eccentric component (18) is connected in a rotationally fixed manner to a rotatably mounted transmission component (8) of a transmission disposed between the starter motor (5) and the starter pinion (2) and has a common rotational axis with the transmission component (8), wherein the eccentric component (18) and the transmission component (8) are two components of a single piece element (18, 8), wherein a longitudinal axis of the starter pinion (2) is disposed eccentrically to a rotational axis of the eccentric component (18) or, respectively, of the transmission component (8), and in that the transmission component (8) is rotatable between an initial position in which the starter pinion (2) is disengaged from the crown gear and a starting position in which the starter pinion (2) is engaged with the crown gear.

2. The starter according to claim 1, wherein adjusting movement of the transmission component (8) is generated via the starter motor (5).

3. The starter according to claim 1, wherein the transmission is a planetary gear set (7) and the transmission component is a ring gear (8) of the planetary gear set (7).

4. The starter according to claim 3, wherein the ring gear (8) meshes with planet gears (11) which are arranged on a planet carrier (10) that is adjustable via a coupling device (22) between a blocking position and a release position.

5. The starter according to claim 4, wherein the blocking position of the coupling device (22) corresponds to an initial position of the ring gear (8) and the release position corresponds to a start position of the ring gear (8).

6. The starter according to claim 4, wherein the coupling device (22) comprises first clutch plates (24) on the planet carrier (10) and second clutch plates (24) on a housing side, wherein the first and second clutch plates (24) are displaceable relative to one another.

7. The starter according to claim 4, wherein a coupling state of the coupling device (22) is set via an actuator (25), adjusting movement of which is dependent on the rotational movement of the ring gear (8).

8. The starter according to claim 7, wherein the actuator of the coupling device (22) is a push nut (25), which is mounted on an external thread of the ring gear (8) and is axially guided in a guide groove (27) on the housing side.

9. The starter according to claim 1, wherein rotational movement of the transmission component (8) between the initial position and the starting position takes place over an angle smaller than 180°.

10. The starter according to claim 1, wherein the transmission component (8) is reset into the initial position while being subjected to a force of a spring element (29).

11. The starter according to claim 1, wherein a freewheel device is disposed in a transmission path between the starter motor (5) and the starter pinion (2).

12. The starter according to claim 1, wherein the transmission component (8) is a first ring gear, and wherein the transmission comprises a double ring gear stage (12) comprising two gears (13, 14) which mesh with a second ring gear (15) which is rotatably mounted in the eccentric component (18).

13. The starter according to claim 12, wherein the second ring gear (15) is spaced axially from the first ring gear (8) along the longitudinal motor axis (4).

14. The starter according to claim 3, wherein the ring gear (8) extends circumferentially around and engages planet gears (11) of the planetary gear set (7).

15. The starter according to claim 1, wherein the transmission component (8) includes radially exterior threads, and wherein a push nut (25) engages the radially exterior threads.

* * * * *